US009997848B2

(12) United States Patent
Wegscheider et al.

(10) Patent No.: US 9,997,848 B2
(45) Date of Patent: Jun. 12, 2018

(54) ELECTRICAL CONNECTION ELEMENT

(71) Applicant: AUDI AG, Ingolstadt (DE)

(72) Inventors: Roland Wegscheider, Mainburg (DE); Daniel Wurm, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days. days.

(21) Appl. No.: 15/386,900

(22) Filed: Dec. 21, 2016

(65) Prior Publication Data

US 2017/0187130 A1 Jun. 29, 2017

(30) Foreign Application Priority Data

Dec. 24, 2015 (DE) ..... 10 2015 016 926

(51) Int. Cl.

| | |
|---|---|
| ***H01R 11/28*** | (2006.01) |
| ***H01R 13/52*** | (2006.01) |
| ***H01R 13/62*** | (2006.01) |
| ***H01R 13/627*** | (2006.01) |
| ***H01R 43/26*** | (2006.01) |

(52) U.S. Cl.

CPC ..... *H01R 11/284* (2013.01); *H01R 13/5219* (2013.01); *H01R 13/62* (2013.01); *H01R 13/6277* (2013.01); *H01R 43/26* (2013.01)

(58) Field of Classification Search

CPC ..... H01R 13/5219; H01R 13/5202; H01R 13/521; H01R 13/523; H01R 13/5216; H01R 11/284

USPC ..... 439/272, 279, 559, 587

See application file for complete search history.

(56) References Cited

U.S. PATENT DOCUMENTS

| | | | | |
|---|---|---|---|---|
| 4,270,827 A * | 6/1981 | Potgieter | ..... | H01R 11/284 439/428 |
| 5,346,408 A * | 9/1994 | Chupak | ..... | H01R 11/284 174/138 F |
| 5,399,103 A * | 3/1995 | Kuboshima | ..... | H01M 2/206 439/504 |
| 5,704,100 A * | 1/1998 | Swan | ..... | F16B 21/186 24/546 |
| 5,861,223 A * | 1/1999 | Motlagh | ..... | H01M 2/202 429/121 |
| 6,030,722 A * | 2/2000 | Kuboshima | ..... | H01M 2/206 429/178 |

(Continued)

FOREIGN PATENT DOCUMENTS

| | | |
|---|---|---|
| DE | 199 17 597 A1 | 10/2000 |
| DE | 100 13 653 A1 | 10/2001 |
| DE | 103 24 903 B3 | 2/2005 |

*Primary Examiner* — Edwin A. Leon
*Assistant Examiner* — Oscar Jimenez
(74) *Attorney, Agent, or Firm* — Henry M. Feiereisen LLC

(57) ABSTRACT

The present invention relates to a connection element for connection of an electrical connector (17) with a cable (15) connected on the connection element (10), wherein the connection element (10) has a mechanism (21) which is configured to secure the connection element (10) in a predetermined position on the electrical connector (17), and wherein the connection element (10) has on a contact region between the connection element (10) the electrical connector (17) that is generated after the connection of the electrical connector (17) with the cable (15) at least one layer made of a sealing material, which is configured to seal a region of the connecting element (10) on the electrical connector (17) in a liquid tight manner.

9 Claims, 1 Drawing Sheet

(56) References Cited

U.S. PATENT DOCUMENTS

| | | | | |
|---|---|---|---|---|
| 7,331,813 | B2 * | 2/2008 | Tsujita | F16B 21/165 439/348 |
| 9,716,339 | B2 * | 7/2017 | Burrow | H01R 13/523 |
| 2011/0237104 | A1 * | 9/2011 | Biesse | H01R 4/4854 439/271 |
| 2014/0308837 | A1 * | 10/2014 | Windenberger | H01R 4/4863 439/345 |

* cited by examiner

ELECTRICAL CONNECTION ELEMENT

CROSS-REFERENCES TO RELATED APPLICATIONS

This application claims the priority of German Patent Application, Serial No. 10 2015 016 926.2, filed Dec. 24, 2015, pursuant to 35 U.S.C. 119(a)-(d), the content of which is incorporated herein by reference in its entirety as if fully set forth herein.

BACKGROUND OF THE INVENTION

The present invention relates to a connection element for connecting a cable with an electrical connection and a method for connecting an electrical connector with the connection element.

The following discussion of related art is provided to assist the reader in understanding the advantages of the invention, and is not to be construed as an admission that this related art is prior art to this invention.

Electrical connections are of great importance for the function and efficiency of electrical circuits. In particular in the motor vehicle field electrical connections are often exposed to an environment in which liquids may lead to a short circuit and may cause permanent damage to a respective electrical circuit.

In addition electrical contacts are critical with regard to operational safety of respective devices and should be protected against unintended contact by a user. Correspondingly electrical connection elements are required which protect connectors against a respective environment, in particular against unintended contact by a user and potential splash water.

It would be desirable and advantageous to provide an improved connection element for connecting a cable with an electrical connector and a method for connecting an electrical connector with the connection element.

SUMMARY OF THE INVENTION

According to one aspect of the present invention a connection element for connecting an electrical connector with a cable connected to the connection element, said connection element includes a mechanism configured to secure the connection element in a predetermined position on the electrical connector; and at least one layer made of a sealing material and provided on a region of the connection element which contacts the electrical connector when the connection element is arranged on the electrical connector so that the electrical connector is connected with the cable, wherein the at least one layer is configured to seal the region of the connection element on the electrical connector in a liquid tight manner in the predetermined position The disclosed invention relates in particular to a connection element with a self-arresting, i.e. self-securing, mechanism, wherein the mechanism is configured to orient the connection element on an electrical connector so that an optimal electrical connection is provided which is protected against environmental influences and in particular against the influence of liquid. According to the invention for this purpose it is provided that the connection element has at least one layer made of a sealing material.

The layer of sealing material provided according to the invention is arranged on the connection element according to the invention, in particular so that this layer can be caused by the mechanism provided according to the invention to assume a predetermined position on an electrical connector, when the connection element is arranged on the electrical connector and protects the position or a region that surrounds the position against entry of liquid. Hereby it is provided that the connection element is secured by the mechanism against a movement, so that the layer made of sealing material remains in a predetermined position also when external forces such as acceleration or pressure forces act on the connection element.

The connection element according to the invention is in particular suited to connect electrical devices, such as for example a connector and a current source, in particular in a vehicle. As a result of the liquid tight layer made of sealing material according to the invention the connection element is in particular suited for external use, in which electrical lines or circuits have to be protected against environmental influences, such as splash water or mechanical influences and corrosion or deformation caused thereby.

It is conceivable that the connection element according to the invention is used for protection of electrical terminals or electrical connections for example of a battery, in particular a 12 V battery, a power electronics for a DC-DC converter for example on or in a vehicle.

By means of the connection element according to the invention a respective electrical connector or a respective electrical connection can be protected against liquids for example of an environment and also against unintended contact by a user or the user can be protected against unintended contact with the electrical connector or the electrical connection.

The term receptacle in the context of the disclosed invention means a receptacle for a part of the connection element according to the invention. A receptacle can in particular be formed by any material protrusion on an electrical connector for example in the form of a groove, in particular an annular groove with an annular collar.

The term mechanism in the context of the present invention means a construction that is configured to provide a force for acting on a respective electrical connector, when the connection element according to the invention is arranged on the electrical connector. A mechanism can in particular be a spring element or a deformable element, for example a material protrusion with a predetermined spring constant.

The term layer made of seating material in the context of the disclosed invention means any technically conceivable arrangement of liquid tight material, in particular a flexible mass for example made of rubber or a plastic.

According to another advantageous feature of the invention, the mechanism is configured to orient the connection element on the electrical connector automatically.

By using an automatic mechanism, i.e., a mechanism that orients the connection element according to the invention without external influence, when the connection element is arranged on the electrical connector, it is possible to automatically orient the connection element in a predetermined direction, and as a result protecting for example a connector in a receptacle against respective environmental influences.

An automatic mechanism can in particular be used for protecting the connection element against displacement due to an externally caused movement of the connection element for example as a result of acceleration forces during a drive. For this purpose the automatic mechanism generates a counter force acting in opposition to respective occurring forces, which retains the connection element in its position or pushes or pulls the connection element back into his position. In order to generate a corresponding counter force the automatic mechanism can have an elastic element, which acts on a respective electrical connector.

In a further possible embodiment of the disclosed connection element it is provided that the mechanism includes at least one spring element, which is configured to releasably clamp the connection element on the electrical connector.

A spring element, such as for example a mechanical spring or an actuator that can be actively controlled, can act on the connection element according to the invention and/or a respective electrical connector and push or pull the connection element against a predetermined position on a respective electrical connector. For this purpose it is provided that upon connection of the electrical connector with the cable the spring element is operatively connected with the connection element as well as with the electrical connector and displaces the electrical connector and/or the connection element so that the connection element and the electrical connector move relative to each other.

According to another advantageous feature of the invention, the spring element can be arranged on the connection element so that the spring element upon connection of the electrical connector with the cable encloses the electrical connection at least partially, so that a force acting on the connection element from a respective environment for displacing the connection element relative to the electrical connector has to overcome push forces as well as tensile forces of the spring element.

A spring element that at least partially surrounds a respective electrical connector, i.e., a spring element that for example encloses the electrical connector, allows distributing a force that is for example exerted by a user on the connection element according to the invention in pull direction as well as in push direction, whereby the force applied by the user is efficiently distributed and the connection element can be secured in its current position.

In addition partial enclosure of a respective electrical connector by the spring element enables a particularly accurate orientation of a connection element on the electrical connector, because the connection element can be moved in a predetermined position for example by multiple pulling or pushing points over multiple partial steps, which for example follow each other temporally.

According to another advantageous feature of the invention, the connection element can include a touch-protection cover, which is configured to at least partially engage into a receptacle provided on the electrical connector in a form-fitting manner.

By using at touch-protection cover made for example of plastic or any other in particular electrically insulating material, electrical elements of the connection element according to the invention can be protected against the influences of a respective environment. In order to arrange the touch-protection cover on a respective electrical connector so that an in particular liquid tight connection is generated, it is provided that the touch-protection cover is shaped for form-fitting engagement of the touch-protection cover in the electrical connector. For this purpose the touch-protection cover can be configured for example as a spring, which can engage in a groove of the electrical connector, when the connection element is arranged on the electrical connector. Of course also any other technically appropriate shape of connections or engagements is conceivable.

According to another advantageous feature of the invention, the mechanism can be configured to orient the touch-protection cover on the electrical connector so that the touch-protection cover form-fittingly engages in the at least one receptacle.

In order to orient the touch-protection cover on a respective electrical connector so that a formfitting and in particular liquid tight connection between the touch-protection cover or the connection element according to the invention and the electrical connector is generated, it is provided that the mechanism provided according to the invention acts on the touch-protection cover for example via a spring force and pushes and/or pulls the touch-protection cover into a receptacle of the electrical connector.

According to another advantageous feature of the invention, the mechanism can be arranged on the touch-protection cover so that a push and/or pulling force can be generated that acts on the touch-protection cover when the connection element is arranged on the electrical connector in order to compress the sealing material when the touch-protection cover engages in the at least one receptacle and to generate a liquid tight region.

The compressive and/or tensile force exerted by the mechanism allows compressing the touch-protection cover or a layer of sealing material arranged on the touch-protection cover during introduction into the receptacle of the electrical connector so that the particularly liquid tight border layer between the touch-protection cover or the sealing material and the electrical connector or the receptacle of the electrical connector is generated.

According to another aspect of the invention an electrical connector includes a body; and at least one receptacle formed on the body, wherein the at least one receptacle is configured to receive a part of a connection element according to the invention so as to form a form fitting transition with the part of the connection element when a force supplied by a mechanism of the connection element acts on the electrical connector.

The disclosed electrical connector serves in particular for providing an electrical connection with the disclosed connection element.

According to another aspect of the invention a method for connecting an electrical connector with a connection element, includes arranging a connection element on an electrical connector, said electrical connector having a receptacle; and with a mechanism of the connection element acting on the electrical connector to thereby secure the connection element on the electrical connector in a predetermined position in which at least a part of the connection element is received in the receptacle so as to form a liquid tight transition between the receptacle and the at least one part of the connection element.

The disclosed method serves in particular for providing an electrical connection between the disclosed electrical connector and the disclosed connection element.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
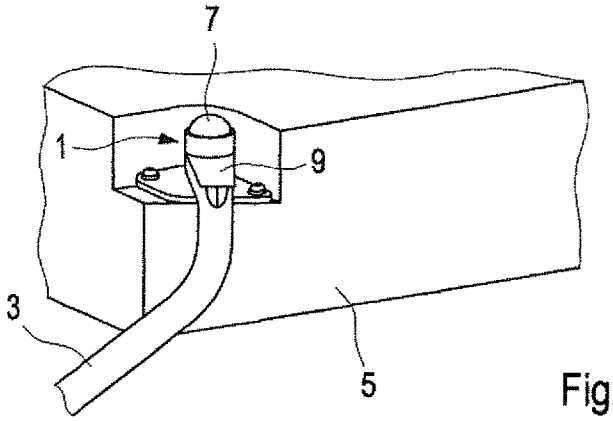
Fig. 1 PRIOR ART
FIG. 1 shows a connection element according to the state-of-the-art.

Throughout all the Figures, same or corresponding elements may generally be indicated by same reference numerals. These depicted embodiments are to be understood as illustrative of the invention and not as limiting in any way. It should also be understood that the Figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

FIG. 1 shows a connection element 1, which connects a cable 3 with an electrical user 5. The connection element 1 includes a coated cap nut 7 and a plastic cap 9, which is configured as a touch- and splash water protection. Because the connection element 1 has no mechanism for securing the connection element 1 on the electrical user 5, it may occur that the coated cap nut 7 partially detaches from the electrical user 5 and splash water can enter into a contact site between the electrical user 5 and the cable 3, which may cause damage to the electrical user 5.

Figure 2:
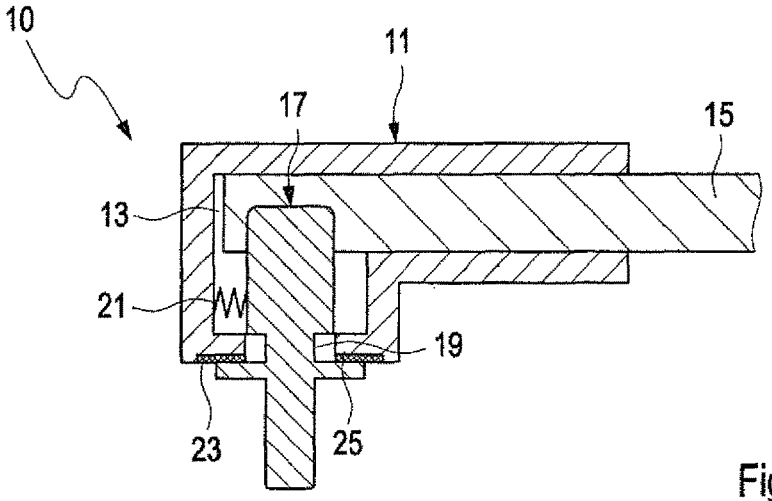
FIG. 2 shows a first view of a possible embodiment of the connection element according to the invention.

FIG. 2 shows a connection element 10, which has a protective cap 11, which protects a region 13 against entry of liquid and contact with a user. In region 13 a cable 15 extends, which is connected with an electrical connector 17, when the connection element 10 is arranged on the electrical connector 17. In order to orient the connection element 10 on the electrical connector 17, the electrical connector 17 has a receptacle 19, in which the protective cap 11 form-fittingly engages. By means of a mechanism 21 arranged on the connection element 10 the connection element 10 is oriented on the electrical connector 17, so that a sealing system 23 made of a layer of sealing material slides together with a part 25 of the protective cap 11 into the receptacle 19 of the electrical connector 17. For this purpose the mechanism 21 is tensioned between the electrical connection 17 and the protective cap 11 and as a result pulls the part 25 with the sealing system 23 into the receptacle 19 of the electrical connector 17. This means that the mechanism 21 exerts a tensile or compression force on the protective cap 11 or the electrical connector 17, so that the protective cap 11 is displaced relative to the electrical connector 17 or the electrical connector 17 is displaced relative to the protective cap 11.

Figure 3:
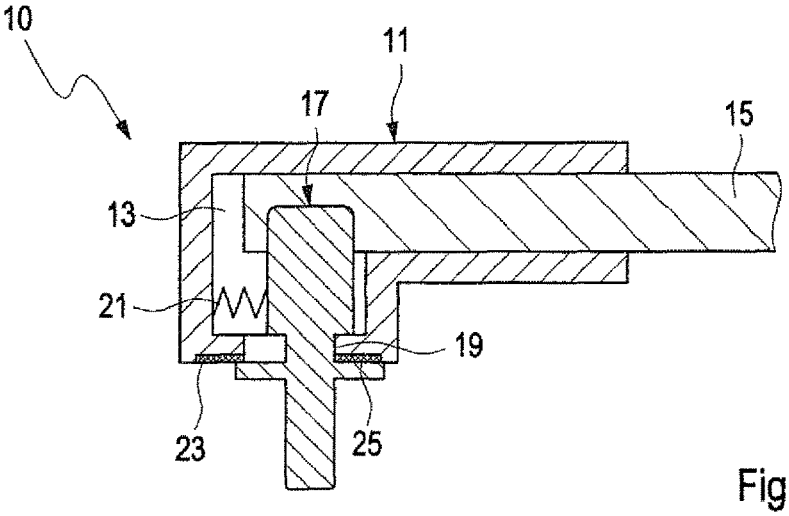
FIG. 3 shows a further view of the connection element of FIG. 2.

FIG. 3 shows the connection element 10 in a position in which the mechanism 21 has pulled or pushed the part 25 of the protective cap 11 together with the sealing system 23 into the receptacle 19 of the electrical connector 17. Correspondingly the mechanism 21 is relaxed and only exerts a very minor tensile or compressive force with respect to the protective cap 11 or the electrical connector 17.

What is claimed as new and desired to be protected by Letters Patent is set forth in the appended claims and includes equivalents of the elements recited therein:

What is claimed is:

1. A connection element for connecting an elongated electrical connector with a cable connected to the connection element, said connection element comprising: a mechanism configured to secure the connection element in a predetermined position on the elongated electrical connector; wherein the connection element and the elongated electrical connector each have a transverse region extending transversely to a direction of elongation of the elongated electrical connector; and at least one layer made of a sealing material and provided on a region of the connection element which contacts the elongated electrical connector when the connection element is arranged on the elongated electrical connector so that the elongated electrical connector is connected with the cable, said at least one layer being configured to seal the transverse region of the connection element on the transverse region of the elongated electrical connector in a liquid tight manner in the predetermined position.

2. The connection element of claim 1, wherein the mechanism is configured to orient the connection element on the elongated electrical connector.

3. The connection element of claim 1, wherein the mechanism includes at least one spring element, which is configured to clamp the connection element on the elongated electrical connector.

4. The connection element of claim 3, wherein the spring element is arranged on the connection element so that upon connection of the elongated electrical connector with the cable via the connection element the spring element at least partially surrounds the elongated electrical connector so that a force acting on the connection element has to overcome a compression force and a tensile force exerted by the spring element to displace the connection element relative to the elongated electrical connector.

5. The connection element of claim 1, further comprising a touch-protection cover configured to at least partially engage form fittingly in a receptacle provided on the elongated electrical connector.

6. The connection element of claim 5, wherein the mechanism is configured to orient the touch-protection cover on the elongated electrical connector so that the touch-protection cover form fittingly engages in the at least one receptacle.

7. The connection element of claim 6, wherein the mechanism is arranged on the touch-protection cover so that the mechanism exerts at least one of a compressive force and a tensile force on at least one of the touch-protection cover and the elongated electrical connector, when the connection element is arranged on the elongated electrical connector so as to compress the sealing material upon engagement of the touch-protection cover in the at least one receptacle and to generate a liquid-tight region of the connection element on the electrical connector.

8. An elongated electrical connector, comprising: a body; and at least one receptacle formed on the body, said at least one receptacle being configured to receive a part of a connection element so as to form a form fitting transition with the part of the connection element when a force supplied by a mechanism of the connection element acts on the elongated electrical connector, wherein the formfitting transition is liquid tight, wherein the connection element and the elongated electrical connector each have a transverse region extending transversely to a direction of elongation of the elongated electrical connector; and at least one layer made of a sealing material is provided on a region of the connection element which contacts the elongated electrical connector when the connection element is arranged on the elongated electrical connector so that the elongated electrical connector is connected with the cable, said at least one layer being configured to seal the transverse region of the connection element on the transverse region of the elongated electrical connector in a liquid tight manner in the predetermined position.

9. A method for connecting an elongated electrical connector with a connection element, said method comprising: arranging a connection element on an elongated electrical connector, said elongated electrical connector having a receptacle; and with a mechanism of the connection element acting on the elongated electrical connector to thereby secure the connection element on the elongated electrical connector in a predetermined position in which at least a part of the connection element is received in the receptacle so as to form a liquid tight transition between the receptacle and the at least one part of the connection element; forming the connection element and the elongated electrical connector each with a transverse region extending transversely to a direction of elongation of the elongated electrical connector; providing at least one layer made of a sealing material on a region of the connection element which contacts the elongated electrical connector when the connection element is arranged on the elongated electrical connector so that the elongated electrical connector is connected with the cable; and configuring said at least one layer as to seal the transverse region of the connection element on the transverse region of the elongated electrical connector in a liquid tight manner in the predetermined position.

* * * * *